US005691705A

United States Patent [19]

East

[11] Patent Number: 5,691,705

[45] Date of Patent: Nov. 25, 1997

[54] ALARM APPARATUS FOR USE ON A TOILET AND METHOD

[76] Inventor: Kenneth H. East, 4689 Adrian Way, Plano, Tex. 75024

[21] Appl. No.: 747,232

[22] Filed: Nov. 12, 1996

Related U.S. Application Data

[63] Continuation-in-part of Ser. No. 498,564, Jul. 6, 1995, Pat. No. 5,594,423.

[51] Int. Cl.[6] ..... G08B 21/00

[52] U.S. Cl. ..... 340/686; 340/689; 340/527; 4/661

[58] Field of Search ..... 340/686, 689, 340/527; 4/661

[56] References Cited

U.S. PATENT DOCUMENTS

| | | | |
|---|---|---|---|
| 4,253,095 | 2/1981 | Schwarz et al. | 340/689 |
| 4,491,991 | 1/1985 | Herbruck | 4/661 |
| 4,706,064 | 11/1987 | Hwang | 340/430 |
| 4,849,742 | 7/1989 | Warrington | 340/686 |
| 4,980,666 | 12/1990 | Hwang | 360/428 |

*Primary Examiner*—Jeffery Hofsass
*Assistant Examiner*—Benjamin C. Lee
*Attorney, Agent, or Firm*—Ralph Bailey

[57] ABSTRACT

A battery operated, self-contained toilet alarm system may be attached to any movable member utilized for gaining access to the toilet for alerting adults in a household with small children that a toilet lid is open and thus presenting a danger of drowning or serious injury to the children utilizes a time delay switch contained in a housing (A) or as a part of a kit to deactivate the alarm for selected periods of time allowing the system to reactivate itself after the delay is over emitting a noise to alert adults within the vicinity of the toilet, even when the toilet lid is only partially open.

7 Claims, 6 Drawing Sheets

Fig. 3.
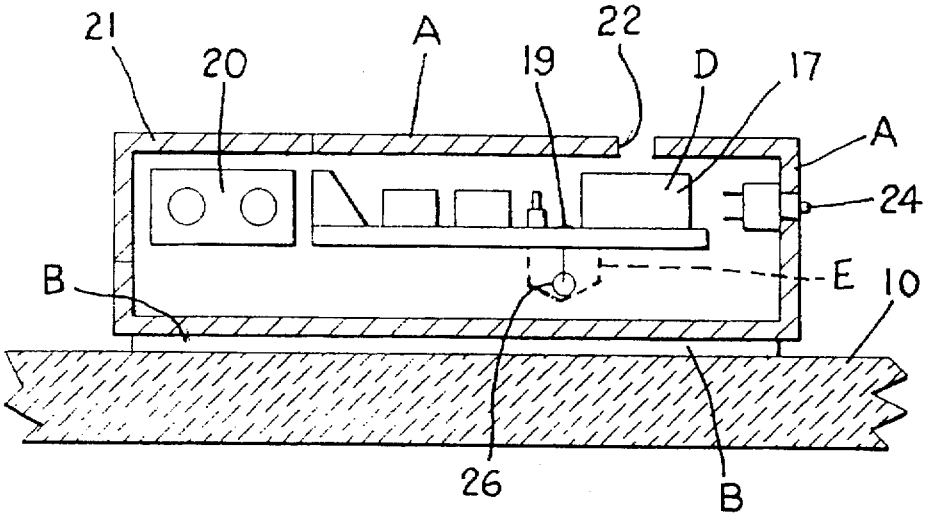
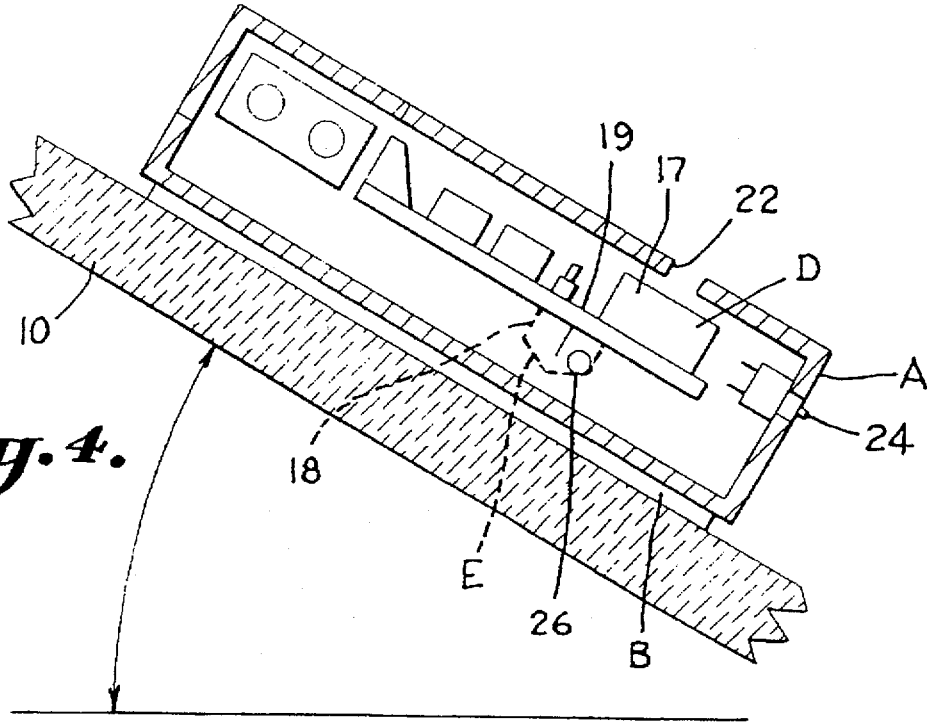
Fig. 4.

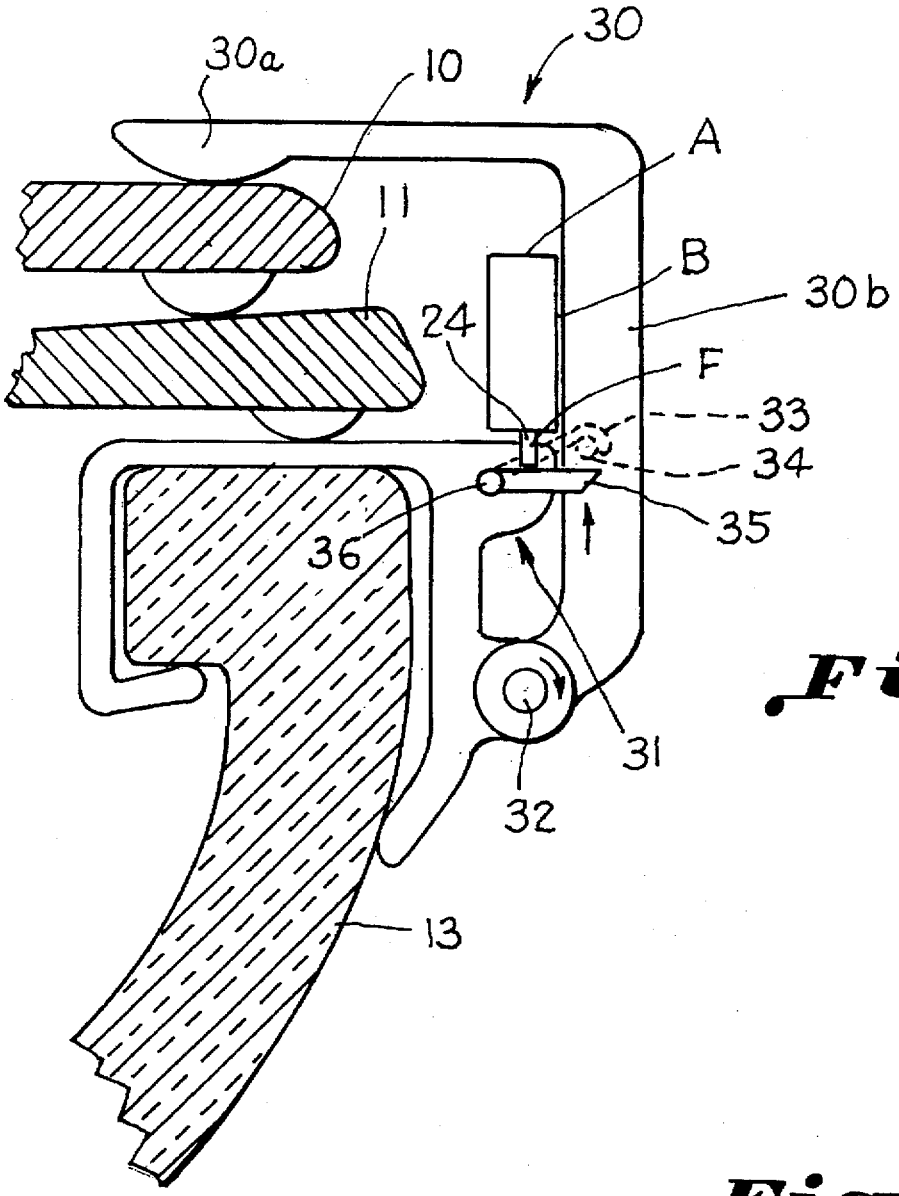
Fig. 8.
Fig. 9.
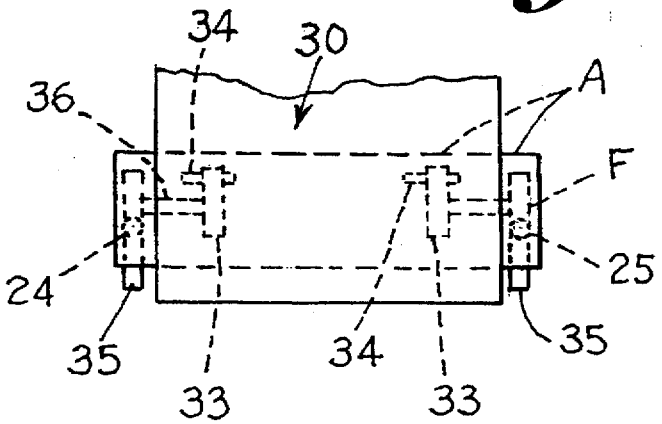

ALARM APPARATUS FOR USE ON A TOILET AND METHOD

This is a Continuation-in-Part of application, Ser. No. 08/498,564, filed Jul. 6, 1995 now U.S. Pat. No. 5,594,423.

BACKGROUND OF THE INVENTION

This invention relates to an alarm device and method utilizing a position controlled switch carried by a movable member for giving a warning that a child has opened a toilet lid.

Every year, many young children drown or become severely and permanently injured when they fall into toilet bowls that were left open by adults, or were opened by the children themselves. Toilet lid locks are readily available in many different designs, but their effectiveness is dependent upon the user of the toilet remembering to close and lock the toilet lid. Efforts have also been made to provide devices to remind the user of a toilet to close the lid after use, but none of these have proved to be satisfactory or fully effective.

Efforts to solve the problem include apparatus disclosed in U.S. Pat. No. 4,849,742, but that solution is problematical in that it is activated only for a limited period of time. Since the danger of a child drowning in a toilet does not diminish after some limited time period, this alarm system would be less than satisfactory as a safeguard against toilet drownings. Also, the signaling device is actuated only after the lid has been fully opened and is resting against the water tank. Because many drownings take place while the lid is not fully opened, the patented device would not prevent those accidents. Furthermore, the patent discloses a device that only actuates the alarm when the toilet has been flushed and the water tank is empty. Accidents often occur in toilets that have not been flushed, and the patented device would not prevent those accidents. Finally, the patented device has several separate components, which does not make for ease of installation.

The following U.S. patents further illustrate the state of the art: U.S. Pat. Nos. 4,055,864, 4,462,023, 4,484,186, 4,995,120, and 4,736,471.

U.S. Pat. No. 4,894,870 illustrates a toilet seat latch wherein a pivoted locking or latching member which must be moved for gaining access for using the toilet is illustrated. It would be desirable for toilet seat locking devices to incorporate an assembly including a position operated switch for providing a suitable signal for giving a warning that a child has opened the toilet lid.

SUMMARY OF THE INVENTION

Accordingly, it is an important object of this invention to alert the adult members of a household, after a user selected amount of time, when a toilet lid has accidentally been left open.

It is another object of the invention to alert adults immediately when a toilet lid has been opened by a child.

It is another object of this invention to provide a childproof mechanism for disabling the signaling device which includes a signaling delay.

This invention further contemplates providing a signal if the lid is only partially opened.

It is still another object of the invention to continue enablement of the signaling device until either the lid is closed or a signaling delay is entered by the user.

Another object of this invention is to provide a completely self-contained unit that requires no external power, which can operate on any style toilet that has a toilet lid.

The apparatus includes a plastic base unit or housing that contains all of the operating components. This base unit has a cover over the base unit, and this cover is attached in such a way as to keep a small child from being able to remove the cover. The base unit is attached to the toilet lid through the use of an adhesive pad. The adhesive pad attaches the device to the lid securely enough to prevent a small child from removing the device from the lid, but still allows removal by an adult. Two small switches protrude from the base, and these switches are used to activate the time delay mechanism that allows adults and older children to delay actuation of the alarm for a predetermined period of time. The power source for this system is a battery, which is located in a receptacle within the base unit under the cover so that a small child is precluded from gaining access thereto.

A signaling device is located within the base unit, and is activated by a position operated switch also located within the base unit. The position operated switch is mounted in such a way so that the base unit may be mounted in any desirable orientation upon the surface of the toilet lid without affecting the ability of the system to perform its designated function. The apparatus also includes a printed circuit board and associated electronics, which may be programmed regarding the delay times of the alarm.

The method contemplates the position operated switch being set to actuate the alarm at a predetermined angle of the toilet lid. It is important that the alarm be activated when the toilet lid is at a small angle, such as 15°, ensuring that the alarm will be enabled when the lid is only slightly opened.

The signal will be audible for a predetermined period of time, and then will remain silent for a predetermined amount of time. Then, the sequence will repeat itself until the device is disabled. This pattern is intended to reduce power consumption in order to extend battery life, and to make the signal more noticeable in a noisy environment.

The signaling device may be disabled in several ways. Closing of the toilet lid will disable the device, such that the toilet lid is either fully closed or at a predetermined angle. Alternatively, the protruding switches may be used to select one of five delay time periods. When one of the delay times is selected, the signaling device is disabled for the specified amount of time. If the toilet lid is still open at the end of the delay time, the signaling device will be enabled and an alarm will sound.

The switches may be operated in a predetermined sequence in order to actuate the delay mechanism. For example, if a user presses the switches in an invalid sequence, the sequence is ignored. These switches provide a childproof mechanism for delaying the enablement of the signaling device.

While the invention has been illustrated in connection with an assembly attached to a toilet lid, a modified form of the invention is disclosed wherein the assembly, including a position operated switch, is attached to a pivoted locking member of a toilet seat latch such as illustrated in U.S. Pat. No. 4,894,870. The invention may be employed wherein attachment of the assembly may be made to any member which must be moved for gaining access for using the toilet.

BRIEF DESCRIPTION OF THE DRAWINGS

The construction designed to carry out the invention will be hereinafter described, together with other features thereof.

The invention will be more readily understood from a reading of the following specification and by reference to the accompanying drawings forming a part thereof, wherein an example of the invention is shown and wherein:

FIG. 3 is a side elevation illustrating components of the alarm system wherein the housing A is fixed to the toilet lid 10;

FIG. 4 is a side elevation similar to FIG. 3 illustrating the mercury switch as being open for actuating a signal upon raising of a lid through a predetermined angle;

FIG. 8 is a transverse sectional elevation illustrating apparatus constructed in accordance with the invention attached for utilization with a toilet seat latch; and FIG. 9 is a top plan view looking from the right in FIG. 8 illustrating the positioning of switch actuator means in relation to mechanism for releasing the toilet seat latch.

DESCRIPTION OF A PREFERRED EMBODIMENT

The drawings illustrate a toilet lid alarm including a housing A. An adhesive B or other suitable attachment means is carried by the housing for securing the housing to a surface of the lid. A receptacle C is provided for a battery carried by the housing. An alarm device D for supplying an audible signal is carried by the housing. A position operated switch E is carried by the housing actuating the alarm device when the toilet lid is raised in excess of a predetermined angle. Thus, an audible signal is given indicating that the lid has been raised. Suitable push button switch actuator means F extend from the housing for deactivating the position operated switch.

Figure 1:
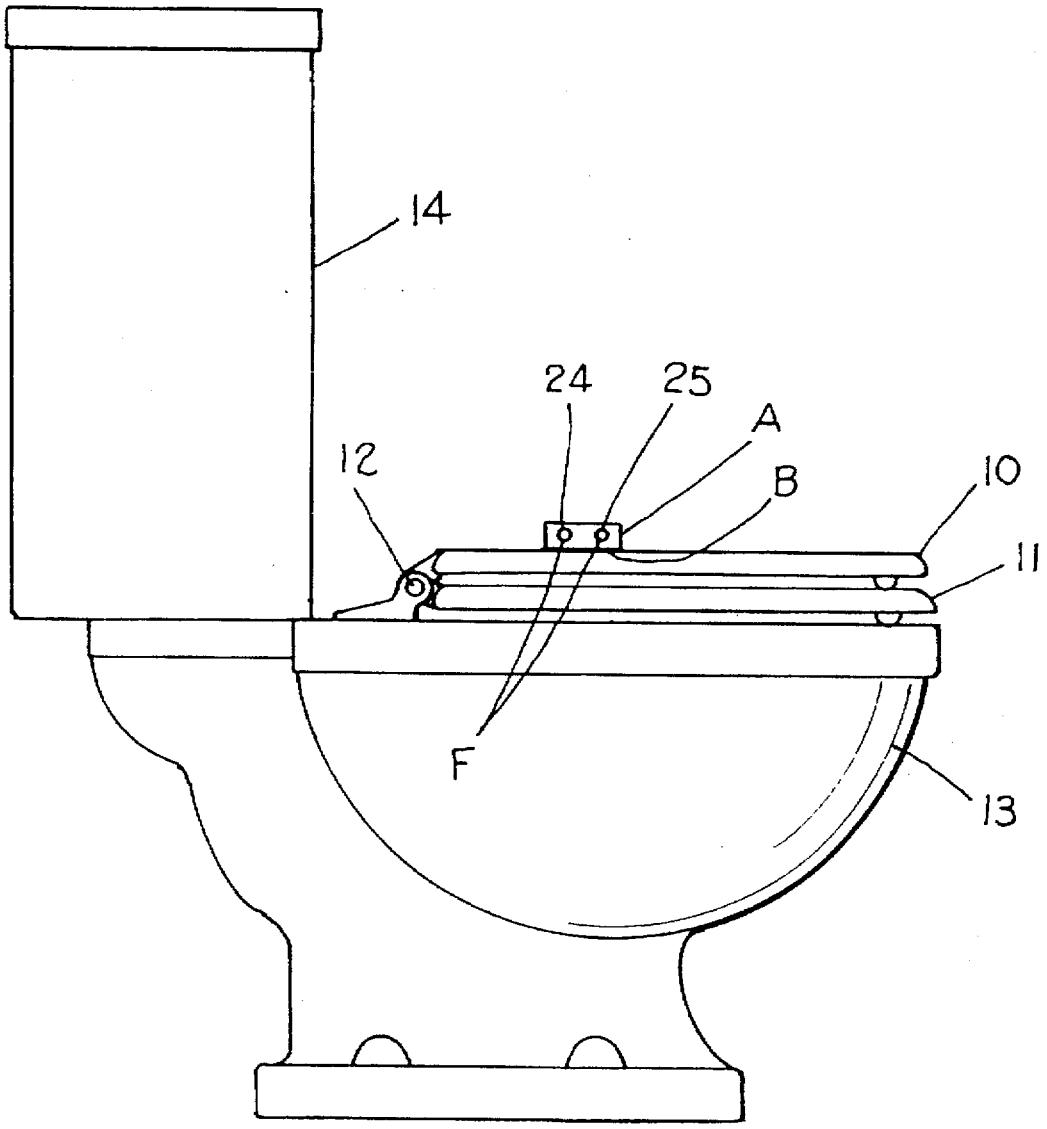
FIG. 1 is a side elevation illustrating a switch constructed in accordance with the invention positioned upon a closed lid of a toilet bowl.
Figure 2:
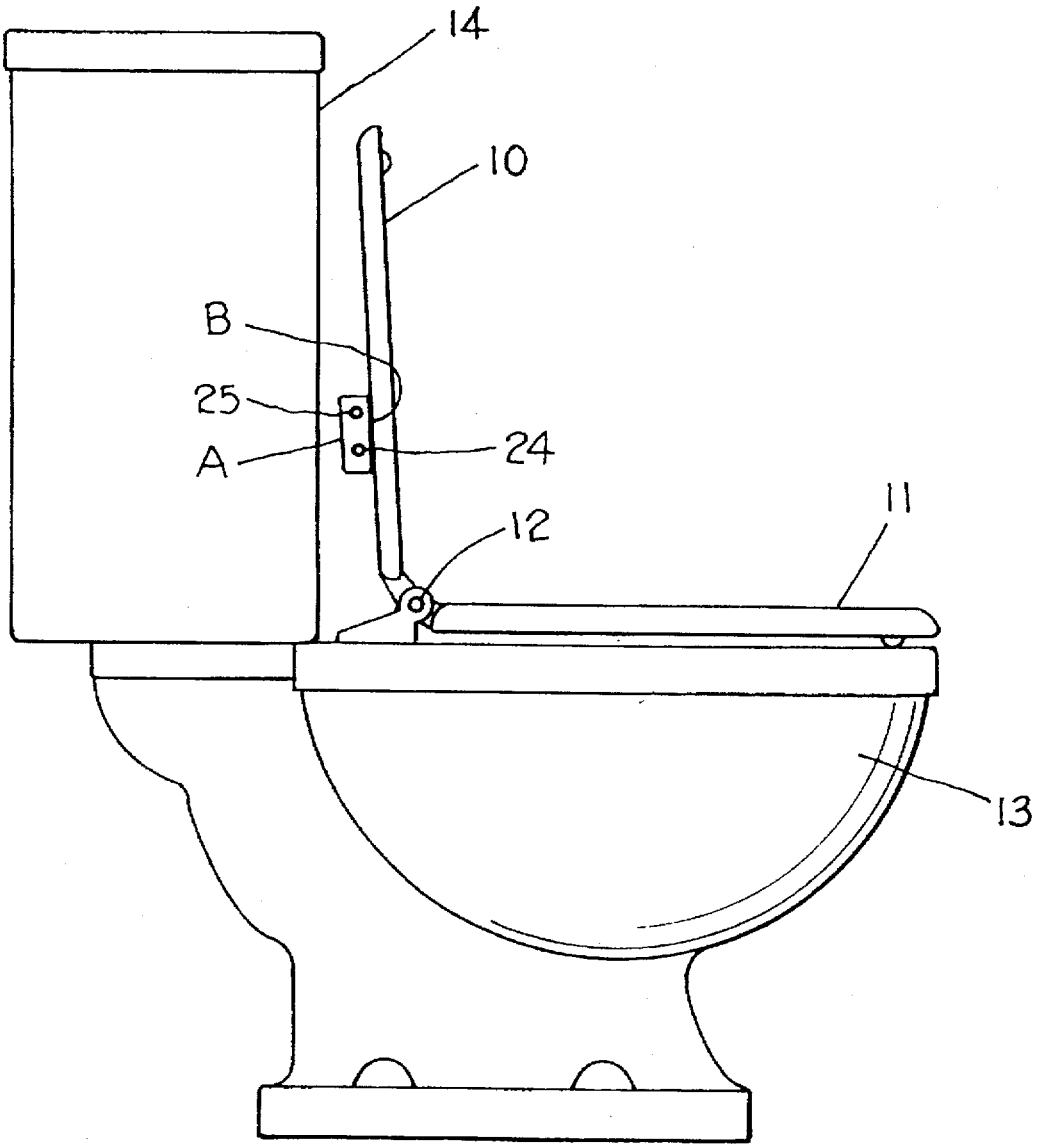
FIG. 2 is a side elevation similar to FIG. 1 but illustrating the lid in fully raised position placing the apparatus in position to give a signal.
Figure 6:
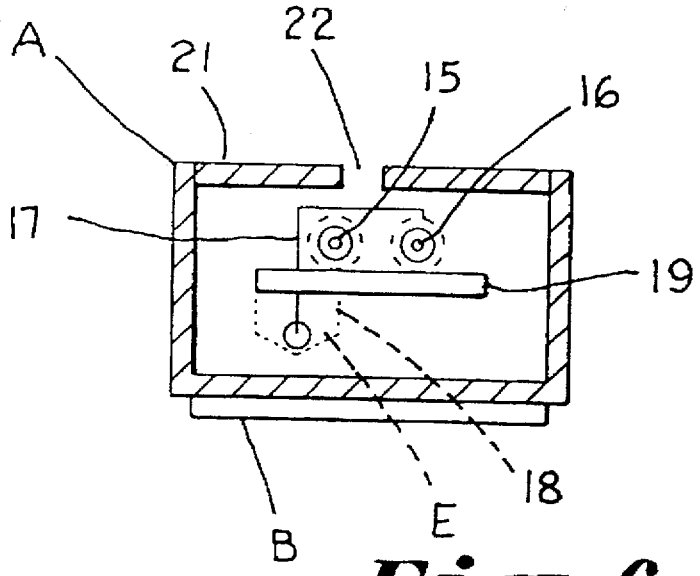
FIG. 6 is an end elevation further illustrating the positioning of the components.

The housing A is illustrated in FIGS. 2 and 3 as being positioned by the adhesive strip B upon the lid 10 above the seat 11. The lid is pivotally attached as at 12. The seat and the lid are carried by the toilet bowl 13 forwardly of the usual water tank 14.

FIGS. 3 through 6 are schematic diagrams illustrating components within the housing A. The housing A contains normally open, momentary contact switches 15 and 16, the signaling device 17, the mercury tilt switch 18, the single board computer 19, and the battery 20. A battery access cover 21 is provided as a part of the enclosure A. An aperture 22 for the signaling device 17 is located in the enclosure such that it is directly over a corresponding aperture 23 in the signaling device.

The two normally open, momentary contact switches are push button switches 24*a* and 25*a* that have actuator means F protruding from the enclosure as push buttons 24 and 25, respectively. These switches are manipulated by the user of the toilet lid alarm to set the delay period of the signaling device 17.

The signaling device 17 is a self-contained Piezo Alarm with internal circuitry. The mercury tip switch 18 includes a metal container that houses an electrode and a droplet of mercury 26. This mercury tip switch is mounted within the device in such a way that when the toilet lid is closed, the mercury tip switch is also closed as shown in FIG. 3. When the toilet lid is open at greater than a predetermined angle, the mercury tip switch is also open as in FIG. 4. This device may be a TO8-1006 switch manufactured by American Electronic Components, Inc.

FIGS. 3 and 4 illustrate the operation of the alarm on the toilet lid. A double-sided adhesive strip or pad B is provided for attachment to the toilet lid 10 in relation to the device. FIGS. 3 indicates the state of the mercury tip switch 18 when the lid is closed. FIG. 4 shows the state of the mercury tip switch 18 when the lid is partially opened. When the toilet lid 10 is closed, the mercury in the tilt switch contacts a suitable electrode. In this position, suitable software together with the hardware determine that the toilet lid 10 is closed, and the signaling device remains silent.

FIG. 4 illustrates the operation of the alarm on the partially open toilet lid and further illustrates the state of the mercury tip switch 18 in an open position. When the toilet lid 10 is opened, the mercury droplet in the mercury tilt switch 18 maintains contact with the electrode, until the toilet lid 10 is opened to a predetermined angle. At this point, the mercury tilt switch 18 ceases to conduct, and the software detects that the toilet lid 10 has been opened. Current will not flow through the mercury tilt switch 18 again until the toilet lid 10 is lowered to an angle lower than the predetermined angle. At this point, the hardware and software detect that the toilet lid 10 has been closed.

Figure 7:
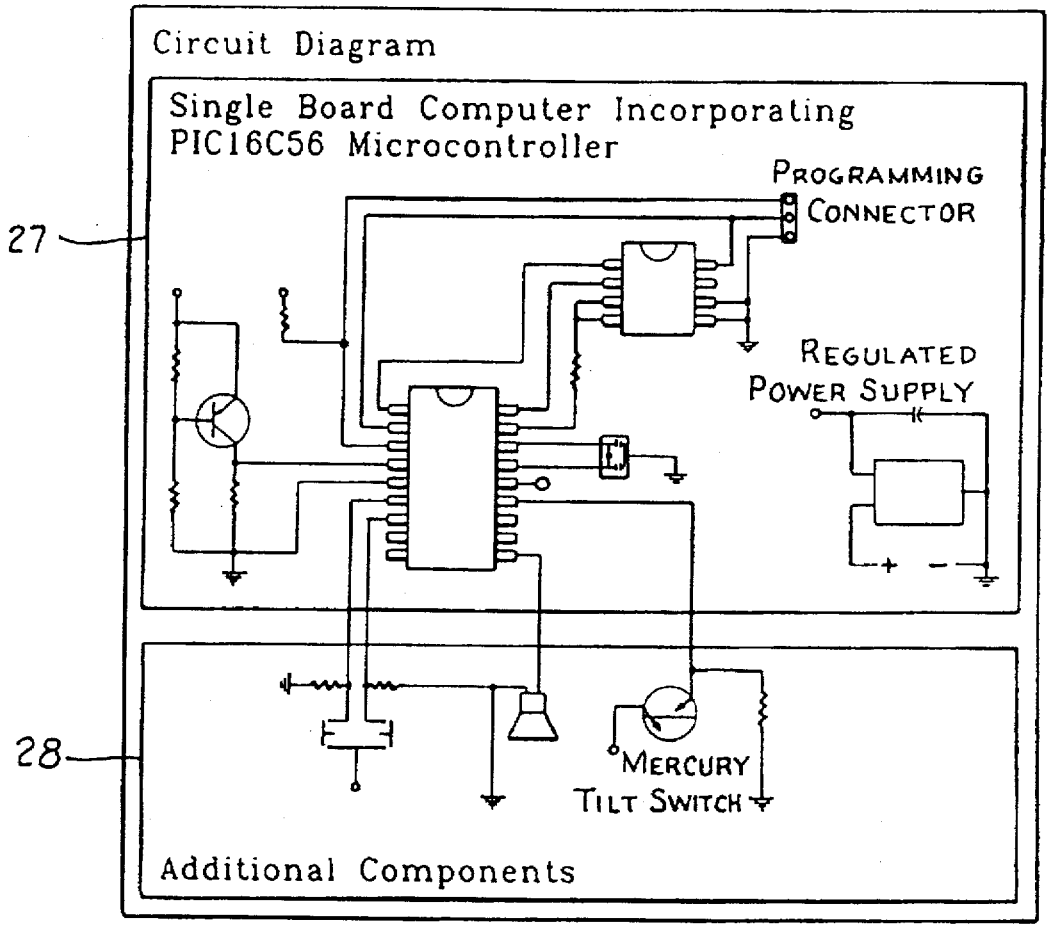
FIG. 7 is a block diagram illustrating the various electrical components of the system.

FIG. 7 is a circuit diagram for a single board computer incorporating the PIC16C56 Microcontroller and additional components. The diagram is divided into two sections. The upper section 27 is a schematic for the single board computer that may be used to build the alarm. The lower section 28 contains the additional circuitry required to create a toilet lid alarm using the single board computer. The single board computer may be a BASIC Stamp manufactured by Parallax, Inc. It contains a PIC16C56 XT Microcontroller that runs a BASIC interpreter, a 256 byte EEPROM that contains a program governing the operation of the stamp. The EEPROM holds a version of a basic program that is required to implement the toilet lid alarm.

The additional components in the lower block are: the signaling device, the mercury tilt switch that detects the toilet lid tilt, the switches for delaying the signaling device, and the components necessary to attach them to the single board computer.

FIGS. 8 and 9 illustrate apparatus constructed in accordance with the invention attached for utilization with a toilet seat latch. FIG. 9 is a plan view looking from the right in FIG. 8 illustrating the positioning of the switch actuator means in relation to mechanism for releasing the toilet seat latch.

Figure 5:
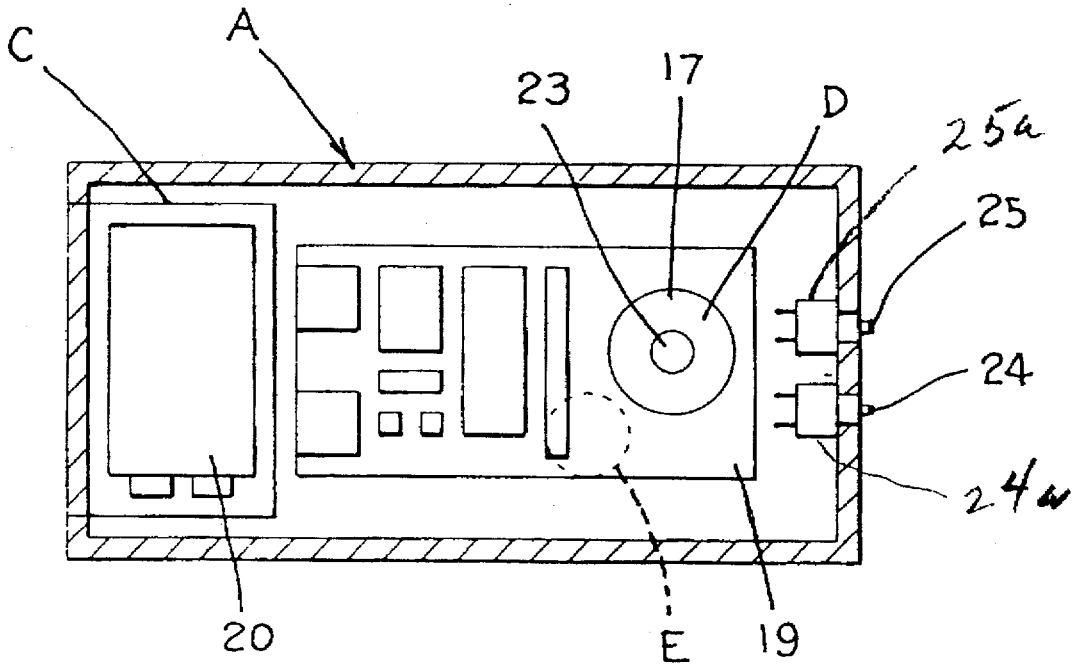
FIG. 5 is a sectional plan view further illustrating the placement of the component of the alarm system.

FIGS. 8 and 9 illustrate an alarm for use on a toilet having a pivoted locking member 30 which must be moved for gaining access for using the toilet. Any movable member such as the toilet lid 10 or a latching arm 30 may be utilized to carry apparatus constructed in accordance with the invention. The invention contemplates an assembly in the housing A and adhesive means B for securing the assembly to the movable member. A receptacle C for a battery is carried as a part of the assembly supplying power to an alarm device D providing an audible signal carried in the assembly as shown in FIG. 5. A position operated switch E is preferably carried in the assembly as illustrated for actuating the alarm device when the member is moved through a predetermined angle. Switch actuator means F include protruding buttons 24 and 25 in said assembly for controlling and deactivating the position operated switch. A time delay may include suitable switches 24*a* and 25*a* as illustrated in FIG. 5 providing a delay period after deactivating the position operated switch, so that the position operated switch is reactivated after the time delay. Thus, an audible signal is given indicating that the member has been moved.

FIG. 8 is a diagrammatic view illustrating a pivoted locking or latching arm member broadly designated at 30 which is carried by a base member broadly designated at 31 attached to an upper lip of a toilet bowl 13 which may be similar to that of U.S. Pat. No. 4,894,870. Many of the components illustrated as being contained in the assembly of the housing A including the mercury switch may require rearrangement as desired. The locking arm 30 is pivotally connected as at 32 to the base member 31 to be pivoted downwardly when latch members 33 are released from latch bars 34 carried by the pivoted arm 30 as illustrated in FIG. 9. It will be noted that a latch operator 35 is carried on each side of the arm 30 and by manually raising them together as indicated by the arrow in FIG. 8 that the latch member 33 which is integral with a shaft 36 on which the arms 35 are integrally connected may be released. The vertical arm 30*b* which is connected at 32 has a horizontal latching portion with a thickened end 30*a* pressing against an upper surface of the lid 10.

The assembly may be carried within a housing A and attached by a suitable adhesive means B to an inner portion of the pivoted arm 30 so as to permit depending buttons 24 and 25 to engage respective arms 35. To raise the seat, both latch operators 35 are raised at the same time. When both are raised, the latches move into a position so as to allow the locking arm 30 to be rotated out of the locked position. When the operators 35 are raised, they also actuate the two delay programming switch buttons 24 and 25. If the operators are pressed simultaneously one time, the delay programmed is one minute. If the operators 35 are pressed simultaneously two times in quick succession, the delay programmed is 15 minutes. Once the locking arm 30 has been released and it is rotated out of the locked position, the sensor switch detects that movement, and starts a countdown timer. If the timer exhausts the programmed time, an alarm is sounded. The alarm continues to sound until either another delay is programmed by pressing the catch release levers, or the locking arm is rotated into the locked position.

The various components instead of being fully contained in the housing A may be mounted separately on the movable member and sold in a package as a kit for installation separately.

While a preferred embodiment of the invention has been described using specific terms, such description is for illustrative purposes only, and it is to be understood that changes and variations may be made without departing from the spirit or scope of the following claims.

What is claimed is:

1. A method for sounding an alarm for use on a toilet indicating access by a child, having a member which must be moved for gaining access for using the toilet, comprising the steps of:

providing an assembly and means for securing the assembly to said member;

mounting a battery in said assembly;

sounding an audible signal responsive to an alarm device powered by said battery carried in said assembly;

actuating said alarm device when said member is moved through a predetermined angle responsive to a position operated switch;

controlling and deactivating said position operated switch responsive to a switch actuator in said assembly; and deactivating said position operated switch after a predetermined time, so that said position operated switch is reactivated after said time delay;

whereby an audible signal is given indicating that the member has been moved.

2. The method set forth in claim 1 including the step of:

causing the audible signal to follow a repeating pattern of being audible for a predetermined period of time and then remaining silent for a predetermined period of time.

3. A kit containing alarm for use on a toilet having a member which must be moved for gaining access for using the toilet, comprising:

a housing;

means for securing said housing to said member;

a receptacle for battery carried in said housing;

an alarm device powered by said battery for supplying an audible signal;

a position operated switch for actuating said alarm device when said member is moved through a predetermined angle;

a switch actuator for controlling and deactivating said position operated switch; and a time delay after deactivating said position operated switch, so that said position operated switch is reactivated after said time delay;

whereby an audible signal is given indicating that the member has been moved.

4. An alarm for use on a toilet having a member which must be moved for gaining access for using the toilet, comprising:

an assembly;

means for securing said assembly to said member;

a receptacle for a battery carried in said assembly;

an alarm device powered by said battery for supplying an audible signal carried in said assembly;

a position operated switch carried in said assembly actuating said alarm device when said member is moved through a predetermined angle;

a timing device causing said audible signal to follow a repeating pattern of being audible for a predetermined period of time and then remaining silent for a predetermined period of time;

a switch actuator in said assembly for controlling and deactivating said position operated switch; and a time delay after deactivating said position operated switch, so that said position operated switch is reactivated after said time delay;

whereby an audible signal is given indicating that the member has been moved.

5. The structure set forth in claim 1 including a pivotal mounting permitting raising of said movable member from a closed position; and wherein said position operated switch is gravity raised.

6. The structure set forth in claim 1 wherein said member is a pivotal latching arm securing a toilet lid in closed position against unwanted opening as by a child.

7. The structure set forth in claim 6 including a first actuator for manually releasing said latching arm, and a second actuator for manually setting said time delay.

* * * * *